United States Patent [19]

Lin

[11] Patent Number: 4,850,590

[45] Date of Patent: Jul. 25, 1989

[54] TABLE TENNIS NET ASSEMBLY

[76] Inventor: Hui Lin, 4F, No. 10, Lin-Sern South Road, Taipei, Taiwan

[21] Appl. No.: 219,573

[22] Filed: Jul. 15, 1988

[51] Int. Cl.[4] ..... A63B 61/00

[52] U.S. Cl. ..... 273/30

[58] Field of Search ..... 273/30, 29 BB, 29 BC, 273/29 BD, 29 BE

[56] References Cited

U.S. PATENT DOCUMENTS

| | | | |
|---|---|---|---|
| 2,817,526 | 2/1957 | Gross | 273/30 |
| 2,859,038 | 11/1958 | Parikos | 273/30 |
| 3,078,094 | 2/1963 | Goodenough | 273/30 |

FOREIGN PATENT DOCUMENTS

| | | | |
|---|---|---|---|
| 5860 | of 1902 | United Kingdom | 273/30 |
| 7990 | of 1902 | United Kingdom | 273/30 |

*Primary Examiner*—Edward M. Coven
*Assistant Examiner*—T. Brown
*Attorney, Agent, or Firm*—Sherman and Shalloway

[57] ABSTRACT

A table tennis net assembly includes a table tennis net and two opposite net supports each of which includes a base piece mounting thereon a vertical hollow cylinder and a bottom piece cooperating with the base piece to be capable of clamping therebetween a portion of a table; one hollow cylinder mounts therein a coiled spring-biassed shaft fixing one end of the net the other end of which is fixed to a stopper which is to be inserted into the other hollow cylinder which has an axial slit slit through the upper portion thereof.

2 Claims, 3 Drawing Sheets

TABLE TENNIS NET ASSEMBLY

BACKGROUND OF THE INVENTION

The present invention relates to a table tennis net, and more particularly to a table tennis net assembly.

In addition to a celluloid ball and a pair of bats, a table tennis game needs a table and a table tennis net assembly centrally disposed thereon. Conventional net assembly includes a net stretched between two opposite net supports similar to C-clamps which, however, can only be secured to the table by continuously screwing on the respective screws. Furthermore, one cannot easily determine to what extent the screws should be screwed onto the table which is not seldom found to be so damaged. In addition, the bare net in storage may tangle together with the support parts and can be damaged in this or other way. Still more, the procedures of screwing the respective screws on and off the table and of winding the net in the support parts are often troublesome and time-consuming. It is therefore tried by the applicant to overcome the above disadvantages encountered by the prior art.

SUMMARY OF THE INVENTION

According to the present invention, a table tennis net assembly includes a table tennis net and two opposite net supports, each including a base piece mounting thereon a vertical hollow cylinder and a bottom piece cooperating with the base piece to be capable of clamping therebetween a portion of a table. One hollow cylinder mounts therein a coiled spring-biassed shaft fixing one end of the net the other end of which is fixed to a stopper which is inserted into the other hollow cylinder which has an axial slit slit through the upper portion thereof.

The object attempting to overcome the prior art shortcomings and the feature of the present invention may best be understood through the following description with reference to the accompanying drawings, in which:

DETAILED DESCRIPTION OF THE PREFERRED EMBODIMENT

Figure 1:
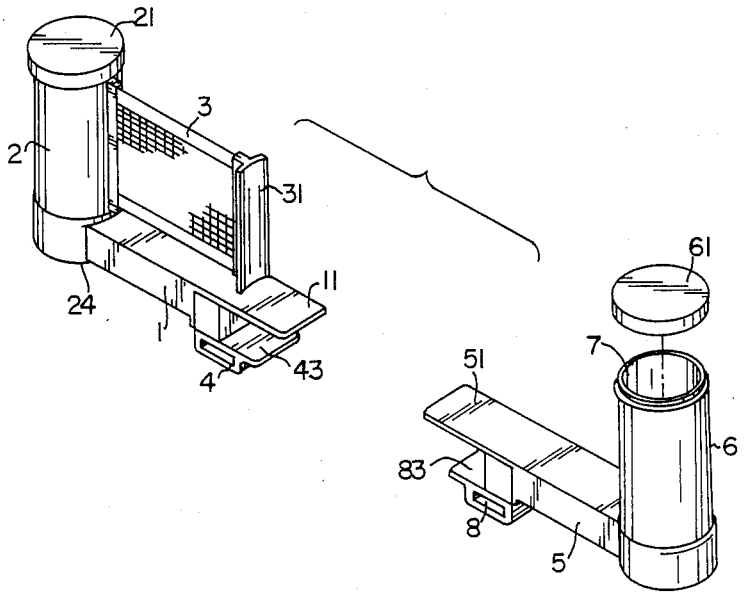
FIG. 1 is a perspective view showing a table tennis net assembly according to the present invention.
Figure 2:
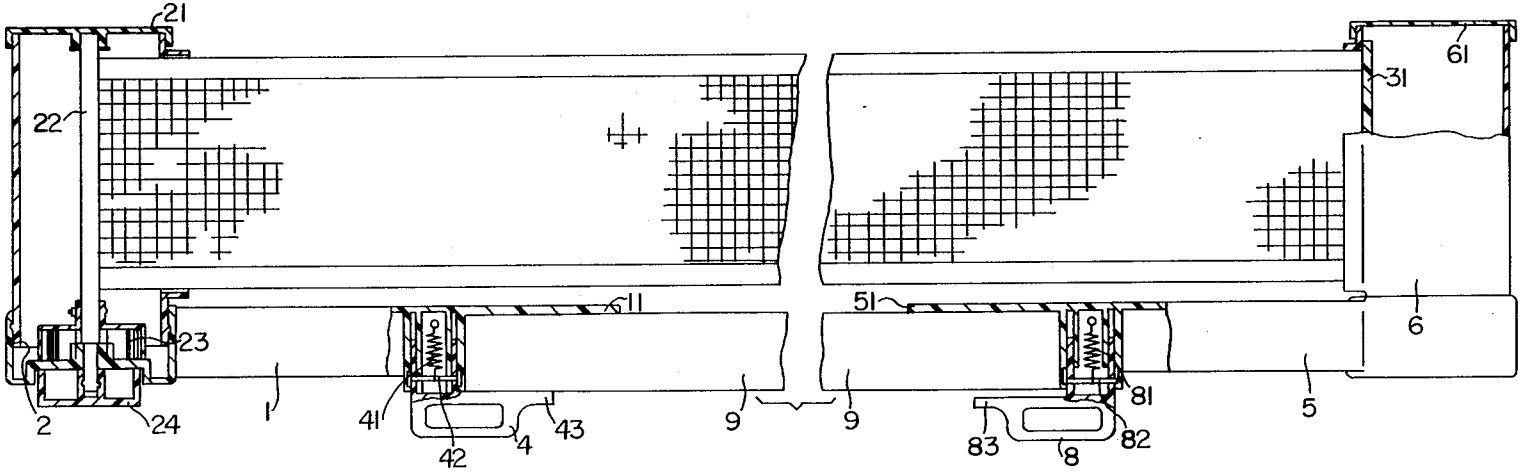
FIG. 2 is a sectional view of a net assembly in FIG. 1.
Figure 3:
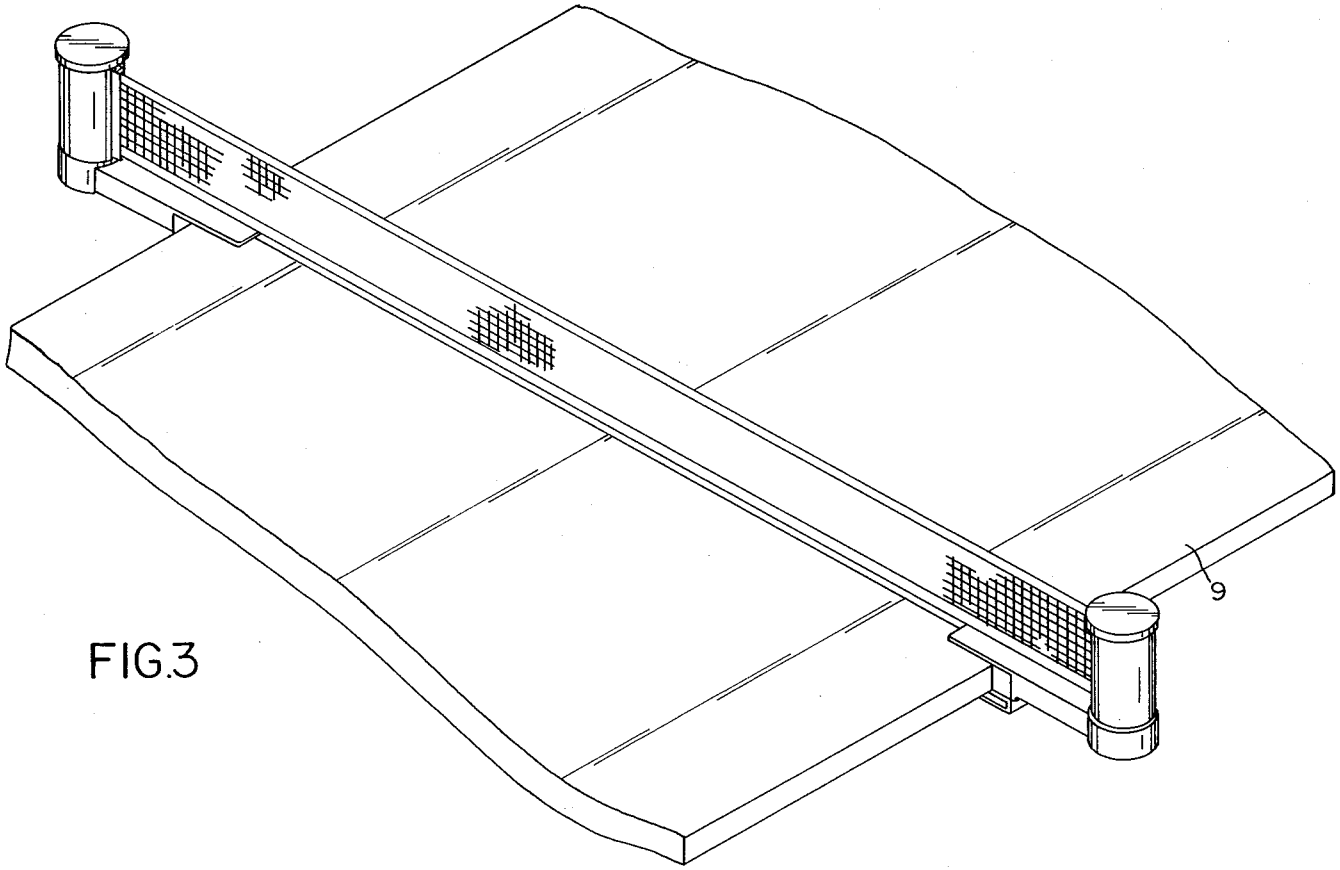
FIG. 3 is a perspective view showing a net assembly in FIG. 1 incorporated on a table.

Referring now to FIGS. 1–3, a table tennis net assembly according to the present invention includes a table tennis net 3 and two net supports each of which includes a base piece 1 (5) having an extention end 11 (51), a hollow cylinder 2 (6) vertically connected to the other end of base piece 1 (5), a bottom piece 4 (8) movably inserted into base piece 1 (5) and having an extension end 43 (83) capable of cooperating with extension end 11(51) to clamp therebetween one of two opposite ends of an intermediate portion of a table tennis table 9, and a spring 41(81) connected between base piece 1 (5) and an engaging end 42(82) of bottom piece 4 (8) for urging ends 11 & 43 (51 & 83) to firmly clamp therebetween the one opposite end.

One hollow cylinder 2 centrally and rotatably mounts therein a shaft 22 fixing thereto an end of net 3 and projecting the bottom end thereof from hollow cylinder 2 to be connected to a handwheel 24, passes thereout table tennis net 3 the other end of which is connected to a stopper 31, and includes a cover 21 and a coiled spring 23 connected between hollow cylinder 2 and shaft 22 for enabling shaft 22 to be restorable after rotated. The other hollow cylinder 6 includes a cover 61 and an axial slit 7 slit through the upper portion thereof so that stoper 31 is stopped by axial slit 7 after inserted into hollow cylinder 6.

Upon using, bottom piece 4 (8) is first urged downwardly (as shown in the right side of FIG. 2) and then released (as shown in the left side of FIG. 2) to let ends 11 & 43 (51 & 83) clamp therebetween the respective opposite end of table 9. After the net supports are put into positions, stopper 31 is pulled to expose net 3 out of hollow cylinder 2 and is inserted into hollow cylinder 6 by having the respective net end positioned in axial slit 7. If stopper 31 is released from hollow cylinder 6, coiled spring 23 will enable shaft 22 to wind thereon net 3. Handwheel 24 can be used to rotate shaft 22 if coiled spring 23 does not have a good springness after having been used for a long period of time and a new one has not replaced the old one.

Through the above description, it should now become readily apparent how an why the present invention can achieve the contemplated object.

What is claim is:

1. A table tennis net assembly comprising:

a table tennis net having a first end and a second end; and first and second net supports adapted to be respectively attached to opposite of an intermediate portion of a table tennis table for stretching therebetween said table tennis net, each said support comprising;

a base having first and second ends, a bottom piece adjustably attached to the underside surface and adjacent said first end of said base;

a tension spring connected between said base and bottom piece for urging said bottom piece towards said base to firmly clamp therebetween one of said sides of a table tennis table;

said first support being comprised of a first hollow cylinder vertically and rigidly connected to said first end of said base of said first support, said first cylinder having a rotatable shaft axially mounted therein and a vertically extending slot through its surface, a coil spring connected between said rotatable shaft and said cylinder for enabling said shaft to be automatically retracted once rotated against said spring;

said second support being comprised of a hollow cylinder vertically and rigidly connected to said first end of said base of said second support and having a vertically extending slot through its surface;

said first end of said net extending through said slot of said first cylinder and attached to said rotatable shaft, said second end of said net extending through said slot of said second cylinder and attached to said second cylinder by a stop means.

2. A table tennis net assembly according to claim 1 wherein the lower end of said shaft projects from said first hollow cylinder and end and is connected to a handwheel for rotating said shaft.

* * * * *